US008953977B2

(12) United States Patent
Itabashi

(10) Patent No.: US 8,953,977 B2
(45) Date of Patent: Feb. 10, 2015

(54) DEVELOPER CONTAINER PROVIDED WITH CAP FOR COVERING FILLING PORT

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 221 days.

(21) Appl. No.: 13/609,322

(22) Filed: Sep. 11, 2012

(65) Prior Publication Data

US 2013/0089357 A1 Apr. 11, 2013

(30) Foreign Application Priority Data

Oct. 6, 2011 (JP) ..... 2011-221586

(51) Int. Cl.
*G03G 15/08* (2006.01)

(52) U.S. Cl.
CPC .. *G03G 15/0886* (2013.01); *G03G 2215/00987* (2013.01)
USPC ..... 399/106; 399/109

(58) Field of Classification Search
CPC ..... G03G 15/0886; G03G 2215/00987
USPC ..... 399/106, 109; 215/294, 296, 354, 355
See application file for complete search history.

(56) References Cited

U.S. PATENT DOCUMENTS

| | | | | | |
|---|---|---|---|---|---|
| 588,784 | A * | 8/1897 | Steffens | | 215/355 |
| 750,257 | A * | 1/1904 | Chapman | | 215/355 |
| 3,070,830 | A * | 1/1963 | Schirmer | | |
| 4,027,776 | A * | 6/1977 | Douglas | | 215/296 |
| 4,391,382 | A * | 7/1983 | Emich | | 215/296 |
| 4,889,251 | A * | 12/1989 | Hojnoski | | 215/296 |
| 5,064,085 | A * | 11/1991 | Ellenberg | | 215/355 |
| 5,926,675 | A * | 7/1999 | Miyano et al. | | 399/109 |
| 6,219,506 | B1 * | 4/2001 | Morinaga et al. | | 399/109 |
| 6,701,106 | B2 * | 3/2004 | Yokoi et al. | | 399/103 |
| 7,565,094 | B2 | 7/2009 | Ishikawa | | |
| 7,970,311 | B2 | 6/2011 | Nakamura et al. | | |
| 2006/0275052 | A1 | 12/2006 | Ishikawa | | |
| 2008/0145094 | A1 | 6/2008 | Nakamura et al. | | |
| 2008/0199227 | A1 * | 8/2008 | Kawai | | |
| 2010/0092211 | A1 * | 4/2010 | Lehmann et al. | | |

FOREIGN PATENT DOCUMENTS

| | | | | |
|---|---|---|---|---|
| JP | 06208301 | A * | 7/1994 | G03G 15/08 |
| JP | 2002-221855 | A | 8/2002 | |
| JP | 2004-085597 | A | 3/2004 | |
| JP | 2006-337502 | A | 12/2006 | |
| JP | 2008-145907 | A | 6/2008 | |
| JP | 2008-203677 | A | 9/2008 | |
| JP | 2008-299125 | A | 12/2008 | |

* cited by examiner

*Primary Examiner* — David Gray
*Assistant Examiner* — Laura Roth
(74) *Attorney, Agent, or Firm* — Banner & Witcoff, Ltd.

(57) ABSTRACT

A developer container includes: a casing having a filling port and a cap for covering the filling port. The filling port is defined by a cylindrical through-hole having an inner peripheral surface, and a protruding portion protruding radially inward from the inner peripheral surface. The cap is attached to the casing in a first direction. The cap includes: a main body portion in a tubular shape having an outer peripheral surface; and a flange portion protruding radially outward from the outer peripheral surface in annular fashion. The flange portion is positioned downstream of the main body portion in the first direction and configured to be in contact with the inner peripheral surface. The protruding portion is positioned upstream of the flange portion in the first direction upon attachment of the cap to the casing.

13 Claims, 12 Drawing Sheets

DEVELOPER CONTAINER PROVIDED WITH CAP FOR COVERING FILLING PORT

CROSS REFERENCE TO RELATED APPLICATION

This application claims priority from Japanese Patent Application No. 2011-221586 filed Oct. 6, 2011. The entire content of the priority application is incorporated herein by reference.

TECHNICAL FIELD

The present invention relates to a developer container for accommodating developer.

BACKGROUND

There is known a developer container that stores toner and has a toner filling port formed therein. The toner filling port is generally closed by a toner cap so as to prevent the toner in the developer container from leaking therefrom through the toner filling port. The toner cap has an insertion portion to be inserted into the toner filling port and a flange portion protruding radially outward from one end of the insertion portion. The flange portion of the toner cap is welded onto an outer surface of the developer container to close the toner filling port while preventing the toner cap from coming off from the toner filling port.

Downsizing of the developer container having the above configuration may pose a problem that a sufficient space for welding the flange portion of the toner cap onto the outer surface of the developer container cannot be ensured. In such a case, the toner cap may come off to cause the toner to leak.

SUMMARY

In view of the foregoing, it is an object of the present invention to provide a compact developer container having a filling port and a cap adapted to the compact developer container.

In order to attain the above and other objects, there is provided a developer cartridge including: a casing having a filling port for filling developer therethrough; and a cap configured to be attached to the casing in a first direction for covering the filling port. The filling port is defined by a cylindrical through-hole having an inner peripheral surface, and a protruding portion protruding radially inward from the inner peripheral surface. The cap includes: a main body portion in a tubular shape having an outer peripheral surface; and a flange portion protruding radially outward from the outer peripheral surface in annular fashion, the flange portion being positioned downstream of the main body portion in the first direction and configured to be in contact with the inner peripheral surface, and the protruding portion being positioned upstream of the flange portion in the first direction upon attachment of the cap to the casing.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

A developer container 1 according to a first embodiment of the present invention will be first described with reference to FIGS. 1 through 6.

1. Construction of Developer Container

Figure 1:
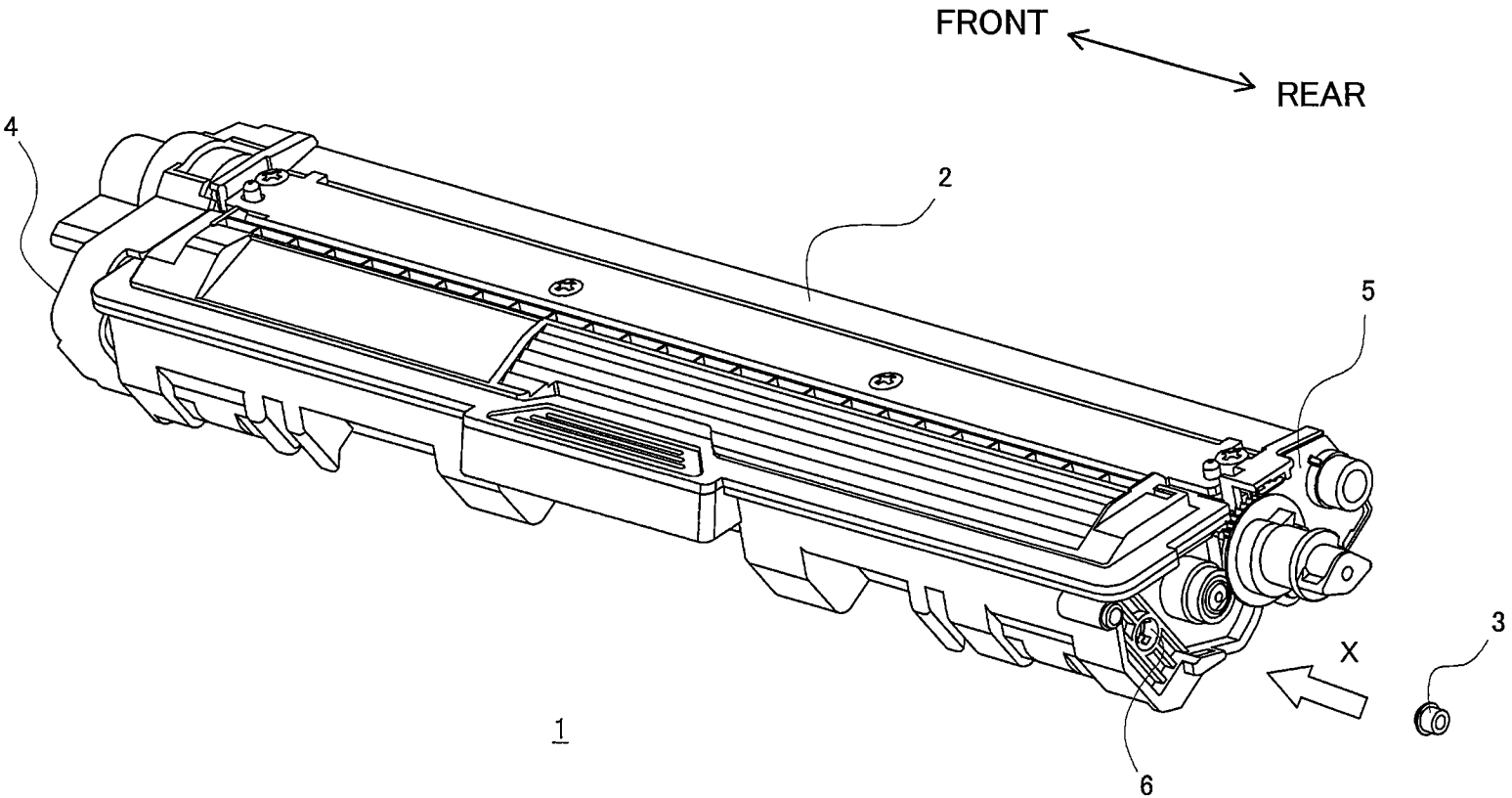
FIG. 1 is a perspective view of a developer container according to a first embodiment of the present invention, the developer container being formed with a filling port.

As illustrated in FIG. 1, the developer container 1 has a casing 2 that contains toner and a cap 3 to be attached to the casing 2.

Throughout the specification, a direction X in which the cap 3 is being attached to the casing 2 of the developer container 1 will be defined as a front-rear direction, as shown in FIG. 1. That is, the cap 3 is assumed to be attached from the rear side toward the front side. A direction orthogonal to the front-rear direction is defined as a radial direction.

The casing 2 has a front side wall 4 and a rear side wall 5. A filling port 6 is formed in the rear side wall 5 of the casing 2. The filling port 6 communicates with inside of the casing 2 so as to receive toner to be filled.

The cap 3 closes the filling port 6 so as to prevent toner (developer) in the casing 2 from leaking therethrough. The cap 3 is attached to the casing 2 by being moved from the rear side to the front side to close the filling port 6.

The cap 3 and the filling port 6 will be described next in detail.

(1) Cap

Figure 2A:
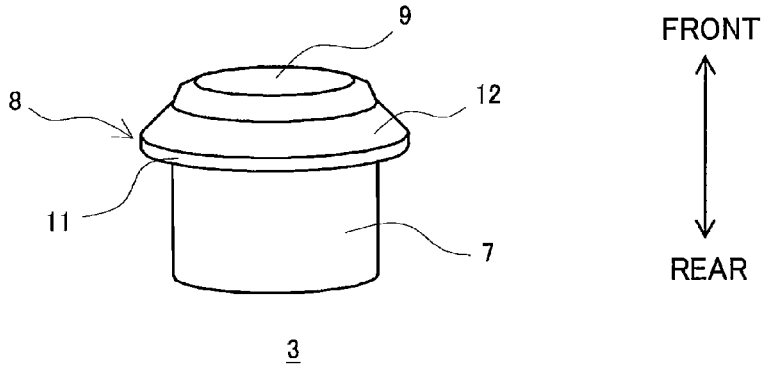
FIG. 2A is a perspective view of a cap according to the first embodiment of the present invention.

The cap 3 is formed of an elastic material such a rubber. As shown in FIG. 2A, the cap 3 includes a main body portion 7, a flange portion 8, and a leading end portion 9.

Figure 2B:
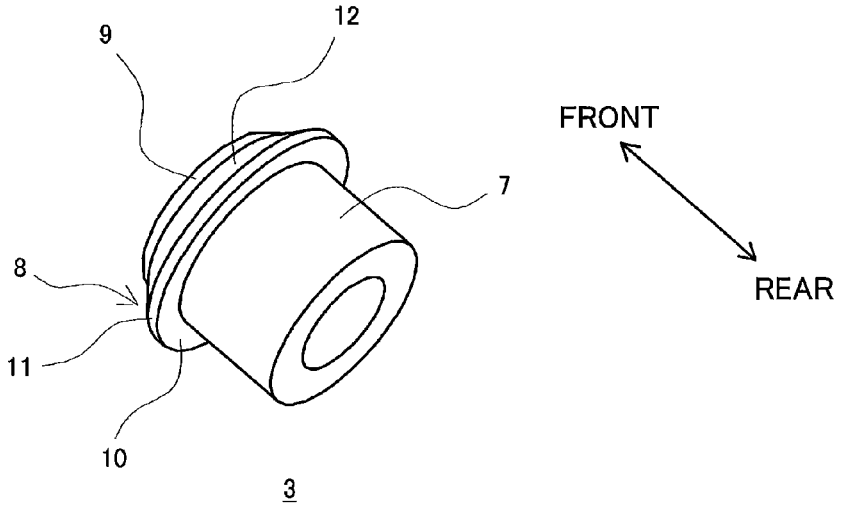
FIG. 2B is a perspective view of the cap of FIG. 2A as viewed in a direction different from that of FIG. 2A.

The main body portion 7 is formed in a tubular shape extending in the front-rear direction, as illustrated in FIG. 2B.

The flange portion 8 protrudes radially outward from a front end portion of the main body portion 7 such that the flange portion 8 is provided in annular fashion on and along an entire outer circumferential surface of the front end portion of the main body portion 7.

Figure 2C:
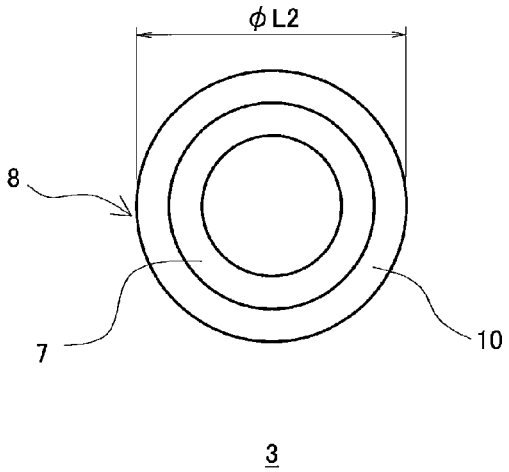
FIG. 2C is a rear side view of the cap of FIG. 2A.

The flange portion 8 has a second orthogonal surface 10, a contacting surface 11, and a cap slope 12. The second orthogonal surface 10 constitutes a rear end portion of the flange portion 8 and extends radially outward from the outer circumferential surface of the front end portion of the main body portion 7. The second orthogonal surface 10 is orthogonal to an outer peripheral surface of the main body portion 7 and has an annular shape as viewed from the rear side, as shown in FIG. 2C. The second orthogonal surface 10 is disposed so as to be also orthogonal to a cylindrical bore portion 13 (to be described later) of the casing 2. The contacting surface 11 is a surface straightly extending frontward from a circumferential edge of the second orthogonal surface 10, as illustrated in FIG. 2B. The contacting surface 11 contacts the cylindrical bore portion 13 (to be described later) of the casing 2. The cap slope 12 is formed continuously from a front end of the contacting surface 11 as illustrated in FIG. 2A and is inclined radially inwardly toward the front side. The cap slope 12 is inclined at about 45 degrees relative to the second orthogonal surface 10.

The leading end portion 9 constitutes a front end portion of the cap 3 and has a circular truncated conical shape. The leading end portion 9 extends frontward from a circumferential edge of a front end portion of the flange portion 8. The leading end portion 9 has a front end that is positioned frontward than the filling port 6 when the cap 3 is attached to the casing 2 as will be described later.

(2) Filling Port

Figure 3A:
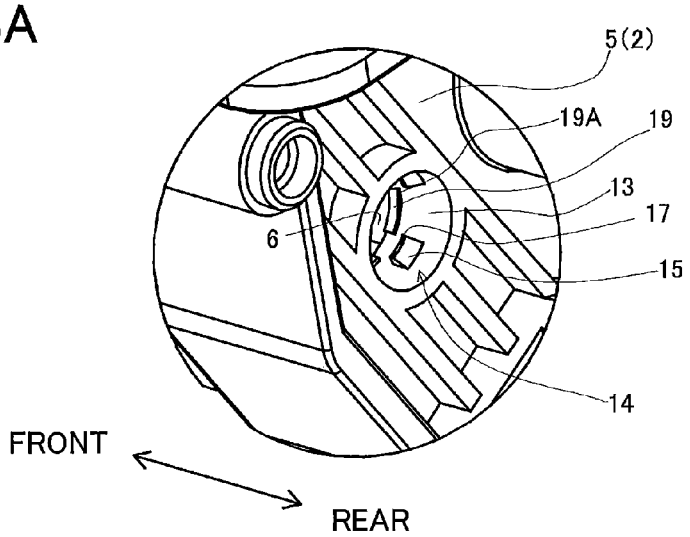
FIG. 3A is a perspective view of the filling port of the developer container according to the first embodiment.

As illustrated in FIG. 3A, the casing 2 has, in the rear side wall 5, a cylindrical bore portion 13, four projection portions 14, and four contacting portions 19. The filling port 6 is constituted by the cylindrical bore portion 13 and the four projection portions 14. The filling port 6 penetrates through the rear side wall 5 in the front-rear direction (a thickness direction of the rear side wall 5).

The cylindrical bore portion 13 is formed in a cylindrical shape extending in the front-rear direction.

Figure 3B:
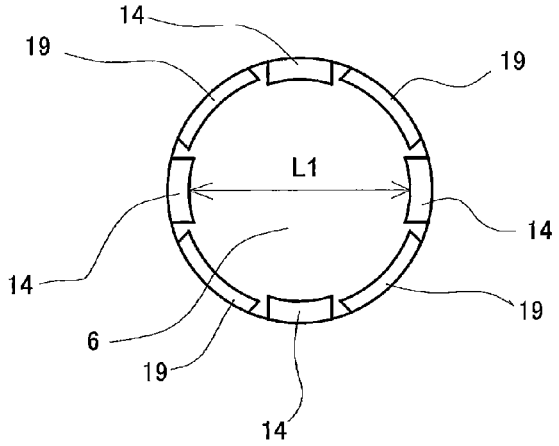
FIG. 3B is a rear side view of the filling port of FIG. 3A.
Figure 3C:
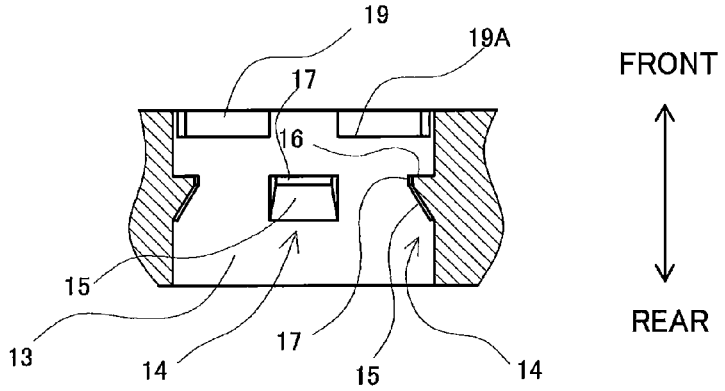
FIG. 3C is a cross-sectional view of the filling port of FIG. 3A.

Each projection portion 14 protrudes radially inward from an inner circumferential surface of the cylindrical bore portion 13 at a position midway in the front-rear direction. As illustrated in FIG. 3B, the four projection portions 14 are provided at equal intervals on and along the inner circumferential surface of the cylindrical bore portion 13. A distance L1 between the two projection portions 14 diametrically opposing each other is smaller than an outer diameter L2 (see FIG. 2C) of the flange portion 8 of the cap 3. As illustrated in FIG. 3C, each projection portion 14 has a slope 15, a first orthogonal surface 16, and a connecting surface 17. The slope 15 is positioned at a rear end of the projection portion 14. The slope 15 extends radially inward toward the front side from the inner circumferential surface of the cylindrical bore portion 13. An angle formed by the inner circumferential surface of the cylindrical bore portion 13 and the slope 15 is about 120 degrees. The first orthogonal surface 16 extends radially inward from the inner circumferential surface of the cylindrical bore portion 13 at a position frontward of the slope 15. The first orthogonal surface 16 extends perpendicularly to the inner circumferential surface of the cylindrical bore portion 13. The connecting surface 17 is a surface connecting between a front end of the slope 15 and an inner end of the first orthogonal surface 16. The connecting surface 17 extends straightly in the front-rear direction, and has a substantially rectangular shape as viewed in the radial direction.

The contacting portions 19 protrude, at a front end of the cylindrical bore portion 13, radially inwardly from the inner circumferential surface of the cylindrical bore portion 13. As illustrated in FIG. 3B, the connecting portions 19 are provided at equal intervals on and along the inner circumferential surface of the cylindrical bore portion 13. Each connecting portion 19 has a rectangular parallelepiped shape and is formed in conformance with the inner circumferential surface of the cylindrical bore portion 13. Each connecting portion 19 has a rear end portion that serves as a corner portion 19A. The corner portion 19A of each connecting portion 19 contacts the cap slope 12 of the cap 3 as will be described later (see FIG. 4C).

(3) Attachment of Cap to Casing

Figure 4A:
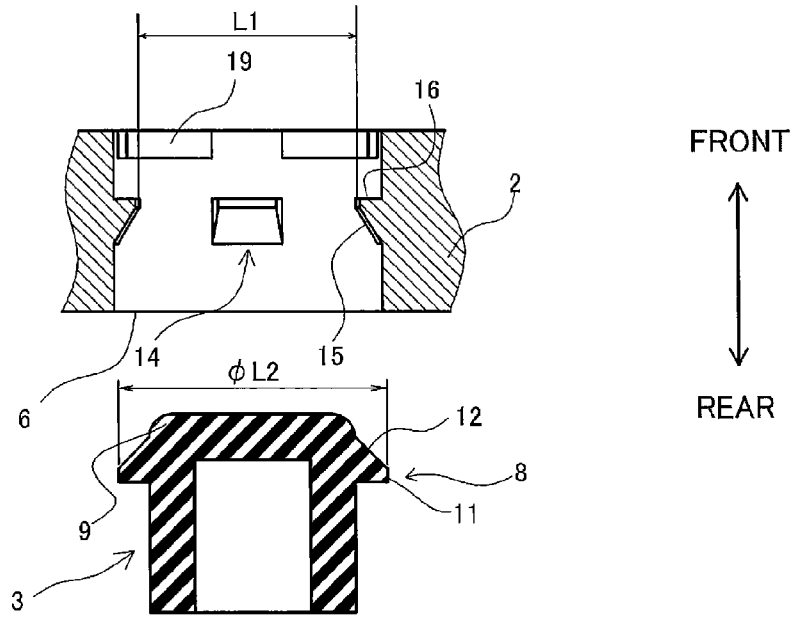
FIGS. 4A through 4C are explanatory views showing how the cap is fitted with the filling port according to the first embodiment.
Figure 4B:
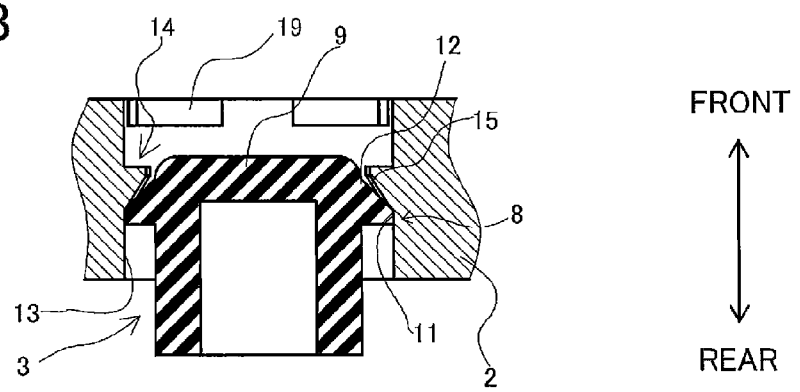
Figure 4C:
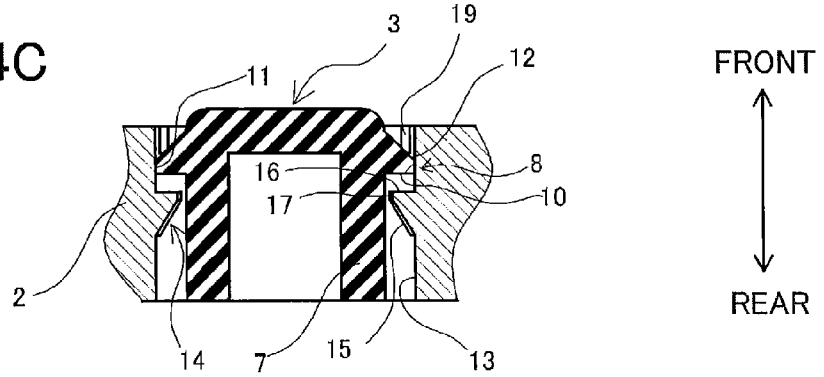

Next, how the cap 3 is attached to the casing 2 will be described with reference to FIGS. 4A to 4C When the cap 3 is to be attached to the casing 2, the cap 3 is disposed on the rear side relative to the filling port 6 as illustrated in FIG. 4A. When the cap 3 is straightly moved to the front side in this state, the cap 3 is inserted into the filling port 6 starting from the leading end portion 9 as illustrated in FIG. 4B. At this time, the contacting surface 11 of the cap 3 is slidingly moved frontward while surface-contacting the inner circumferential surface of the cylindrical bore portion 13. Then, when the front end of the cap 3 reaches the projection portions 14 as illustrated in FIG. 4B, the cap slope 12 and the slope 15 of each projection portion 14 are brought into contact with each other. When the cap 3 is further moved frontward in this state, the cap 3 is further inserted frontward while the cap slope 12 and each slope 15 are in sliding contact with each other. At this time, since the distance L1 between the two opposing projection portions 14 is smaller than the outer diameter L2 of the flange portion 8, the flange portion 8 of the cap 3 is moved frontward while being deformed radially inward. When the flange portion 8 of the cap 3 has passed the projection portions 14 of the casing 2, the contacting surface 11 of the flange portion 8 contacts once again the inner circumferential surface of the cylindrical bore portion 13 of the casing 2, as illustrated in FIG. 4C. The attachment of the cap 3 to the casing 2 is thus completed.

In a state where the cap 3 is attached to the casing 2, the contacting surface 11 of the flange portion 8 of the cap 3 is in surface-contact with the entire inner circumferential surface of the cylindrical bore portion 13 of the casing 2 to be tightly fitted thereto.

It should be noted that the distance L1 between the two opposing projection portions 14 is larger than an outer diameter of the main body portion 7. Therefore, when the cap 3 is attached to the casing 2, the main body portion 7 of the cap 3 and the projection portions 14 of the casing 2 do not contact each other, as shown in FIG. 4C.

Further, in this state, the projection portions 14 of the casing 2 are positioned on the rear side in the front-rear direction relative to the flange portion 8 of the cap 3. Therefore, each first orthogonal surface 16 of the casing 2 and the second orthogonal surface 10 of the cap 3 are opposed to each other at a predetermined interval in the front-rear direction. Therefore, when the cap 3 is moved rearward, the first orthogonal surface 16 of the casing 2 and the second orthogonal surface 10 of the cap 3 abut against each other. The cap 3 is thus prevented from coming off from the casing 2.

Further, a rear end portion of the cylindrical bore portion 13 of the casing 2 and a rear end portion of the main body portion 7 of the cap 3 are flush with each other as illustrated in FIG. 4C.

A cap fitting jig 34 may be used to attach the cap 3 to the casing 2. How the cap 3 is attached to the casing 2 using the cap fitting jig 34 will be described next with reference to FIGS. 5A to 5C.

Figure 5A:
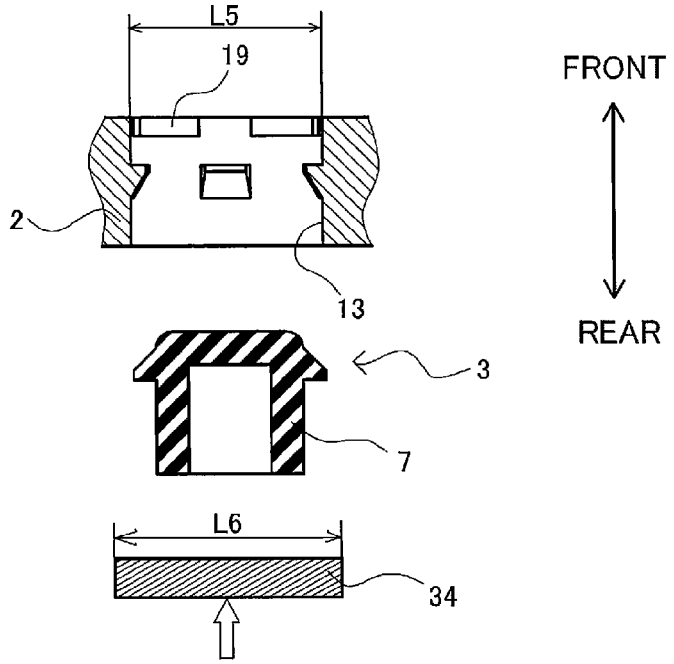
FIGS. 5A through 5C are explanatory views showing how the cap of the first embodiment is fitted with the filling port by using a cap fitting jig.
Figure 5B:
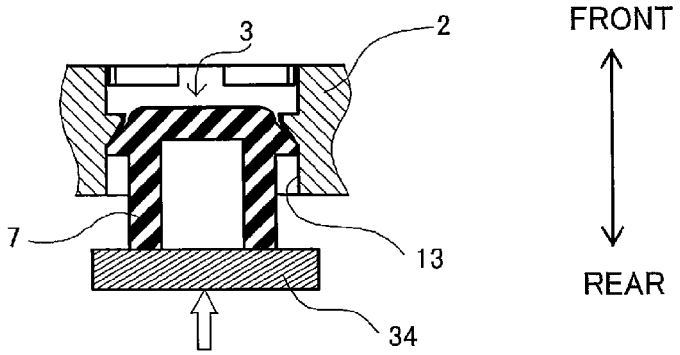
Figure 5C:
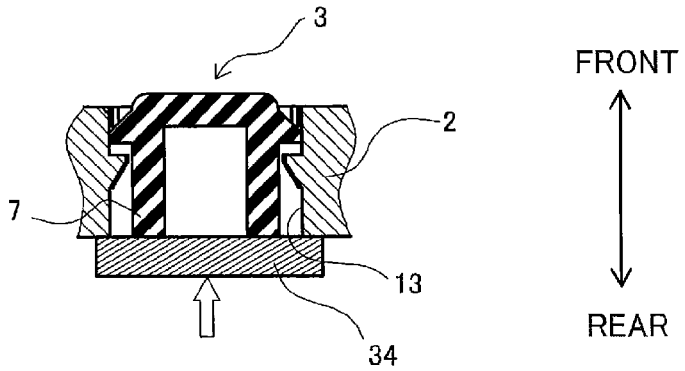

As illustrated in FIG. 5A, a length L6 of the cap fitting jig 34 in the radial direction is longer than an inner diameter L5 of the cylindrical bore portion 13 of the casing 2. As illustrated in FIG. 5B, the cap fitting jig 34 is pushed from the rear side while being in contact with the rear end of the main body portion 7 so as to attach the cap 3 to the casing 2. When the cap 3 is attached to the casing 2 using the cap fitting jig 34, a front end of the cap fitting jig 34 abuts against the casing 2, as illustrated in FIG. 5C. This prevents the cap 3 from being pushed into the casing 2 too far. Further, the rear end portion of the main body portion 7 of the cap 3 and the rear end portion of the cylindrical bore portion 13 of the casing 2 can be made flush with each other.

2. Advantageous Effects (1) As described above, the developer container 1 has the casing 2 having the filling port 6 for toner filling and the cap 3 to be attached to the casing 2 for closing the filling port 6. The casing 2 has the cylindrical bore portion 13 having a cylindrical shape and the four projection portions 14 protruding radially inwardly from the inner circumferential surface of the cylindrical bore portion 13. The cylindrical bore portion 13 and the projection portions 14 constitute the filling port 6.

The cap 3 has the main body portion 7 having a cylindrical shape and the flange portion 8 protruding radially outward from the outer peripheral surface of the main body portion 7. The flange portion 8 is provided on and along the entire outer peripheral surface of the main body portion 7 so as to be in contact with the entire inner circumferential surface of the cylindrical bore portion 13 of the casing 2. The projection portions 14 of the casing 2 are disposed on the rear side in the front-rear direction relative to the flange portion 8 of the cap 3 when the cap 3 is fitted with the filling port 6.

According to the above configuration, eve when the cap 3 is moved rearward after attached to the casing 2, the cap 3 does not come off from the casing 2 since the projection portions 14 of the casing 2 and the flange portion 8 of the cap 3 abut against with each other. Thus, even if there is no space for welding the cap 3 onto the casing 2 due to downsizing of the developer container 1, the cap 3 can be prevented from coming off from the casing 2.

Further, the flange portion 8 of the cap 3 is in contact with the entire inner circumferential surface of the cylindrical bore portion 13 of the casing 2. Toner in the casing 2 is therefore prevented from leaking therefrom.

(2) Each projection portion 14 has, at the front side thereof, the first orthogonal surface 16 extending orthogonally to the front-rear direction, while the flange portion 8 of the cap 3 has, at the rear side thereof, the second orthogonal surface 10 which is orthogonal to the front-rear direction and opposes the first orthogonal surface 16 in the front-rear direction when the cap 3 is fitted with the filling port 6.

With this configuration, when the cap 3 is moved rearward, the first orthogonal surface 16 and the second orthogonal surface 10 contact each other on the respective surfaces thereof in a direction orthogonal to the front-rear direction, the direction being coincident with a moving direction of the cap 3. This makes the cap 3 much less likely to come off.

(3) Each projection portion 14 has, at the rear side thereof, the slope 15 sloping radially inwardly toward the front side.

As a result, the cap 3 is easier to be attached to the casing 2.

(4) Four projection portions 14 are provided to be aligned along a circumference of the inner circumferential surface of the cylindrical bore portion 13 of the casing 2.

With this configuration, the cap 3 can be prevented from coming off from the casing 2 more reliably.

(5) The flange portion 8 has, at the front side thereof, the cap slope 12 that is inclined radially inward toward the front side.

Attaching the cap 3 to the casing 2 thus becomes easier.

(6) The rear end portion of the cylindrical bore portion 13 of the casing 2 and the rear end portion of the main body portion 7 of the cap 3 are substantially flush with (aligned with) each other, as shown in FIG. 4C.

With this structure, a seal for covering the cap 3 may easily be attached to the casing 2. Further, the attached seal is difficult to peel off. Further, since the cap 3 is absent between the seal and the casing 2, downsizing can be achieved.

(7) The casing 2 has, at the front end thereof, the contacting portion 19 configured to contact the cap slope 12 of the cap 3 when the cap 3 is attached to the casing 2.

With this configuration, even if the cap 3 is pushed too far to the front side when being attached to the casing 2, the cap 3 can be prevented from moving to an internal space of the casing 2.

3. Recycling of Developer Container

Figure 6:
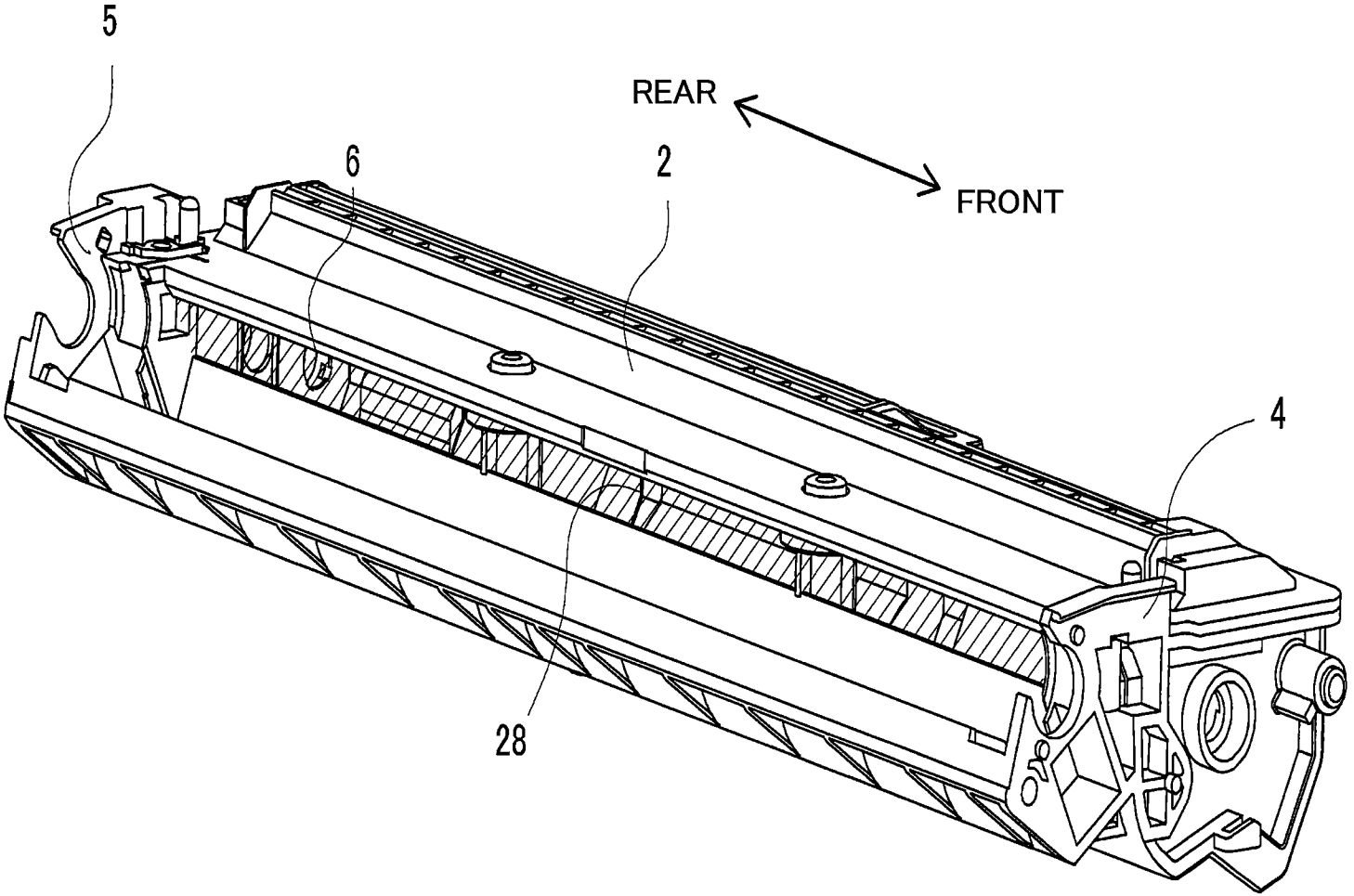
FIG. 6 is a perspective view of the developer container of FIG. 1, in which a developing roller and a supply roller (not shown) have been removed from the developer container to expose an opening formed therein.

Next, recycling of the developer container 1 will be described with reference to FIG. 6.

In order to recycle the developer cartridge 1 after toner in the casing 2 has been used up, the cap 3 needs to be removed from the casing 2. However, when a user tries to remove the cap 3 from the rear side, the first orthogonal surface 16 of the casing 2 and the second orthogonal surface 10 of the cap 3 abut against each other to prevent removal of the cap 3. Hence, for removing the cap 3, the cap 3 is pushed deep into the casing 2. The cap 3 is then taken out through an opening 28 (shown by diagonal lines in FIG. 6) that is exposed after components such as a developing roller and a supply roller (not shown) have been removed from the casing 2 of the developer container 1.

More specifically, the cap 3 is first pushed frontward until the rear end portion of the cap 3 passes beyond the front end portion of the cylindrical bore portion 13 of the casing 2 in the front-rear direction. Then, the developing roller, the supply roller and other components (all not shown) are removed from the developer container 1 to expose the opening 28. The cap 3 that has been pushed into the casing 2 is then taken out from the casing 2 through the opening 28.

Recycling of the developer container 1 can be thus realized.

An opening for taking out the cap 3 from the casing 2 may be formed at a position different from that of the opening 28. For example, such an opening through which the cap 3 can pass may be formed in the front side wall 4 opposite to the rear side wall 5 in which the filling port 6 is formed.

Second Embodiment

A filling port 206 according to a second embodiment of the present invention will be described with reference to FIGS. 7A to 7C. The filling port 206 has a projection portion 200 instead of the four protruding portions 14, and constructions other than the projection portion 200 are the same as those of the first embodiment. Thus, like parts and components are designated by the same reference numerals as those of the first embodiment to avoid duplicating description.

Figure 7A:
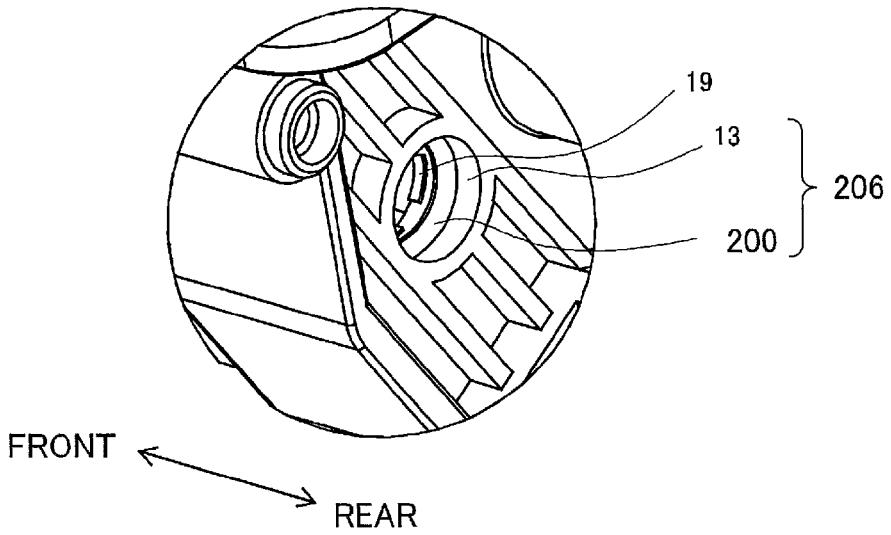
FIG. 7A is a perspective view of a filling port according to a second embodiment of the present invention.
Figure 7B:
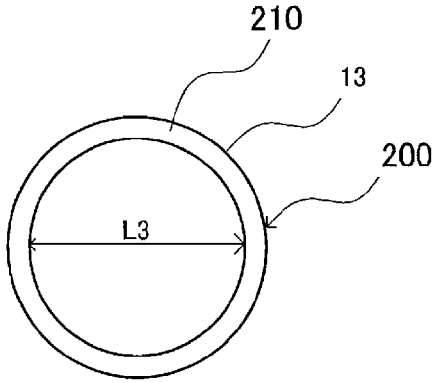
FIG. 7B is a rear side view of the filling port of FIG. 6A.

As illustrated in FIG. 7A, the projection portion 200 projects radially inward from the inner circumferential surface of the cylindrical bore portion 13 at a position midway in the front-rear direction such that the projection portion 200 extends over an entire circumference of the cylindrical bore portion 13. As illustrated in FIG. 7B, therefore, the projection portion 200 has an annular shape as viewed from the rear side. An inner diameter L3 of the projection portion 200 is smaller than the outer diameter L2 of the flange portion 8 of the cap 3. The projection portion 200 has a slope 210, a first orthogonal surface 220, and a connecting surface 230 as illustrated in FIG. 7C. The slope 210 constitutes a rear end of the projection portion 200. The slope 210 extends from the inner circumferential surface of the cylindrical bore portion 13 such that the slope 210 is inclined radially inward toward the front side. The first orthogonal surface 220 extends inwardly in the radial direction of the cylindrical bore portion 13 from the inner circumferential surface thereof so as to be orthogonal to the inner circumferential surface of the cylindrical bore portion 13. The connecting surface 230 is a surface connecting between a front end of the slope 210 and an inner end portion of the first orthogonal surface 220 and extending straightly in the front-rear direction.

With the above-described configuration, even when the cap 3 that has been attached to the casing 2 is moved rearward, the second orthogonal surface 10 of the cap 3 is inevitably brought into contact with the first orthogonal surface 220 of the projection portion 200. Thus, the cap 3 can be prevented more reliably from coming off from the casing 2.

Figure 7C:
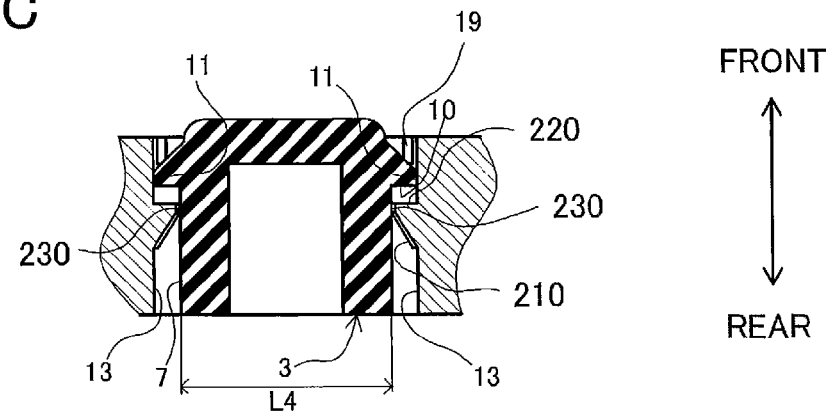
FIG. 7C is a cross-sectional view of the filling port of FIG. 6A, wherein the cap according to the first embodiment has been fitted with the filling port according to the second embodiment.

Further, as illustrated in FIG. 7C, the inner diameter L3 of the projection portion 200 may be made equal to an outer diameter L4 of the main body portion 7 so as to bring an entire circumferential surface of the projection portion 200 (the connecting surface 230) and the entire outer peripheral surface of the main body portion 7 of the cap 3 into contact with each other. In this case, even if toner leaks from between the contacting surface 11 of the cap 3 and the cylindrical bore portion 13 of the casing 2, the toner can be reliably prevented from leaking outside the casing 2 by the contact between the projection portion 200 of the casing 2 and the main body portion 7 of the cap 3.

Third Embodiment

Figure 8:
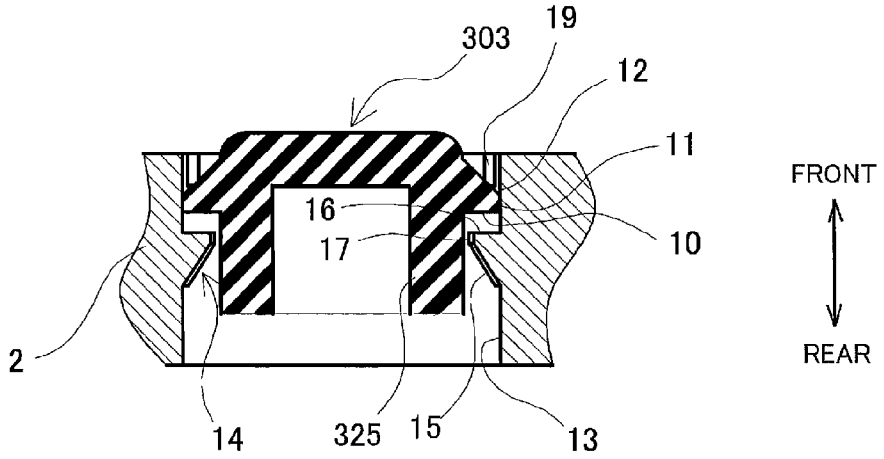
FIG. 8 is a cross-sectional view of an area in the vicinity a filling port according to a third embodiment of the present invention, wherein a cap according to the third embodiment has been fitted with the filling port.

A cap 303 according to a third embodiment will be described with reference to FIG. 8, wherein like parts and components are designated by the same reference numerals as those of the first embodiment to avoid duplicating description.

The cap 303 has a main body portion 325 whose length in the front-rear direction is shorter than that of the main body portion 7 of the cap 3 of the first embodiment in the front-rear direction. Therefore, as shown in FIG. 8, when the cap 303 is fitted with the cylindrical bore portion 13 of the casing 2, a rear end of the main body portion 325 of the cap 303 is positioned frontward relative to the rear end portion of the cylindrical bore portion 13.

With this configuration, the cap 303 is not exposed rearward from the cylindrical bore portion 13, thereby preventing a user from carelessly touching the cap 303.

Fourth Embodiment

Figure 9:
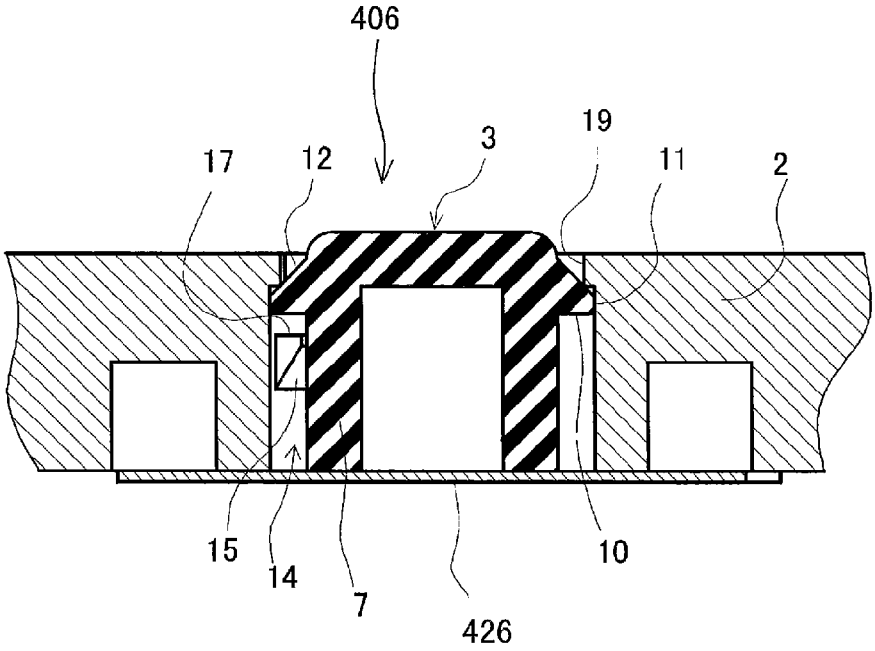
FIG. 9 is a cross-sectional view of an area in the vicinity a filling port according to a fourth embodiment of the present invention.

FIG. 9 shows a construction around a filling port 406 according to a fourth embodiment. In the fourth embodiment, the cap 3 and the casing 2 whose configurations are the same as those of the first embodiment are employed. Therefore, detailed descriptions therefor are omitted.

In the fourth embodiment, the developer container 1 is provided with a seal 426 as an example of a covering member. The seal 426 is attached to the casing 2 from the rear side of the main body portion 7 so as to cover the cap 3.

With this configuration, the cap 3 is not exposed rearward from the cylindrical bore portion 13, thereby preventing a user from carelessly touching the cap.

A resin cover may be used in place of the seal 426. In this case, the resin cover is screw-fixed to the casing 2 so as to cover the cap 3.

Fifth Embodiment

Figure 10:
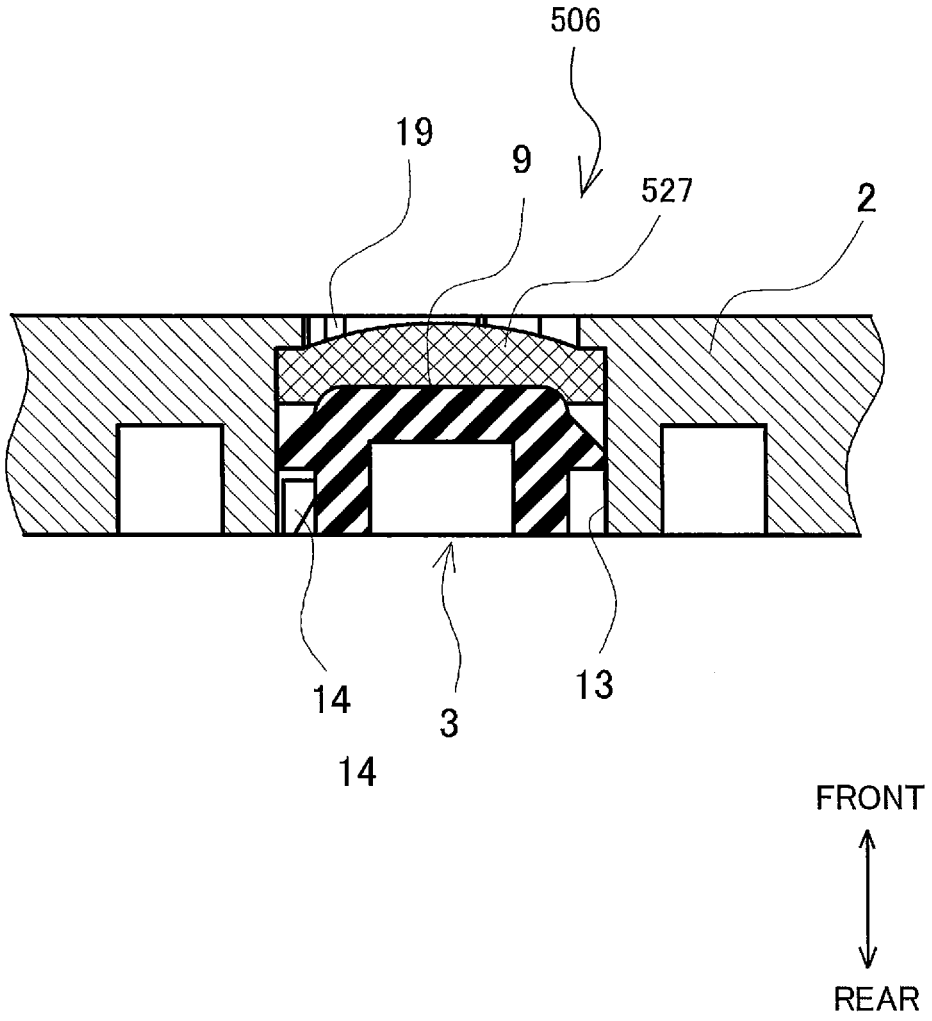
FIG. 10 is a cross-sectional view of an area in the vicinity a filling port according to a fifth embodiment of the present invention.

FIG. 10 shows a construction around a filling port 506 according to a fifth embodiment. In the fifth embodiment, the cap 3 and the casing 2 whose configurations are the same as those of the first embodiment are employed. Therefore, detailed descriptions therefor are omitted.

In the fifth embodiment, the developer container 1 further includes a sponge 527 as an example of a deformable member.

As illustrated in FIG. 10, the sponge 527 is disposed frontward of the leading end portion 9 of the cap 3. The sponge 527 is tightly fitted to the entire inner circumferential surface of the cylindrical bore portion 13 of the casing 2 in the radial direction. The sponge 527 has a front end portion that contacts the contacting portions 19 of the casing 2, and a rear end portion that contacts the leading end portion 9 of the cap 3.

With this structure, the sponge 527 can be resiliently deformed to be tightly fitted to the cylinder potion 13 of the casing 2, thereby ensuring further reliable prevention of toner leakage from the casing 2.

Sixth Embodiment

Figure 11:
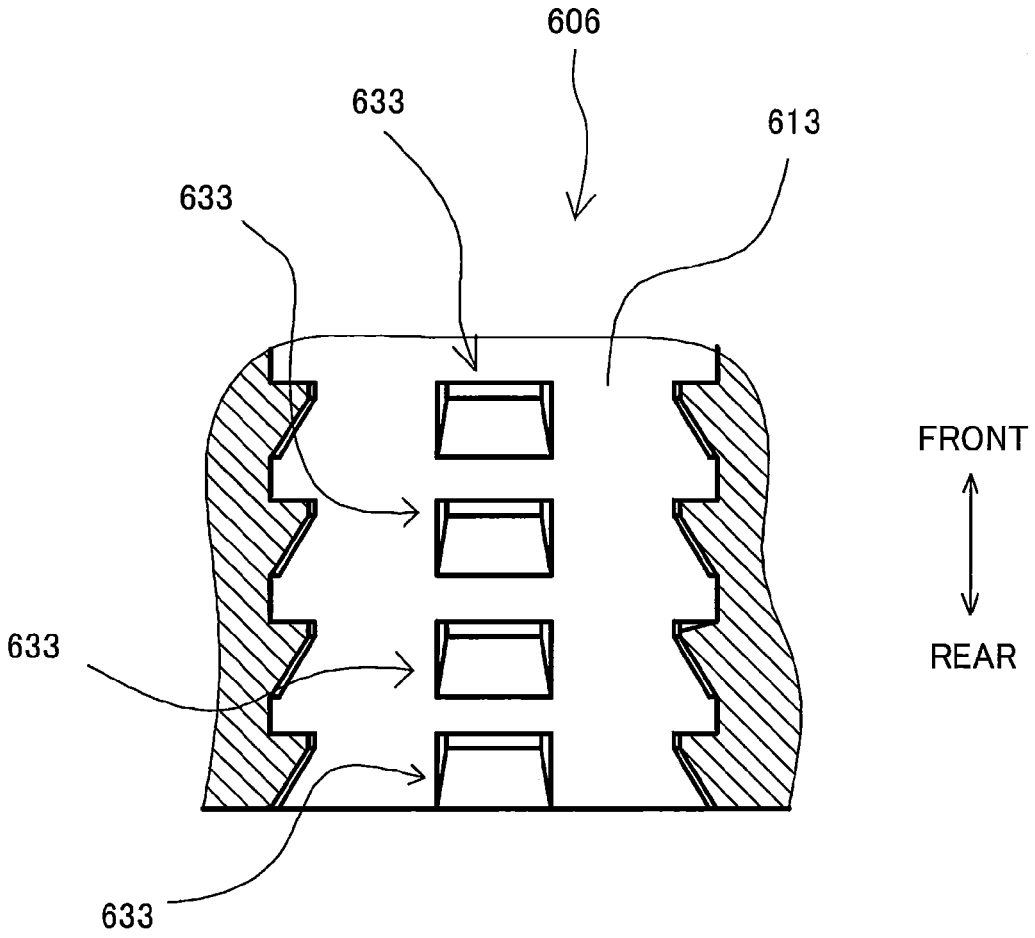
FIG. 11 is a partially-enlarged cross-sectional view of a filling port according to a sixth embodiment of the present invention.

FIG. 11 shows a filling port 606 according to a sixth embodiment. Instead of the four projection portions 14 of the first embodiment, sixteen projection portions 633 are provided in the sixth embodiment. Specifically, for explanatory purpose, the sixteen projection portions 633 are divided into four sets of four projection portions 633. Each group of projection portions 633 is provided at positions different from one another in the front-rear direction. Each projection portion 633 has the same shape as that of the projection portion 14 of the first embodiment.

More specifically, as illustrated in FIG. 11, four groups of projection portions 633 are arranged on an inner circumferential surface of a cylindrical bore portion 613 at equal intervals in the front-rear direction. Each group includes four projection portions 633 arranged in the same manner as the four projection portions 14 of the first embodiment.

With this configuration, the cap 3 can be further reliably prevented from coming off from the casing 2.

Seventh Embodiment

Figure 12A:
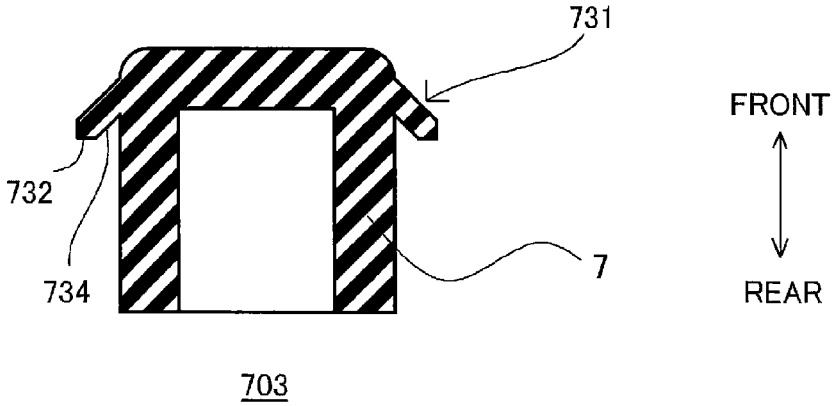
FIG. 12A is a cross-sectional view of a cap according to a seventh embodiment of the present invention.
Figure 12B:
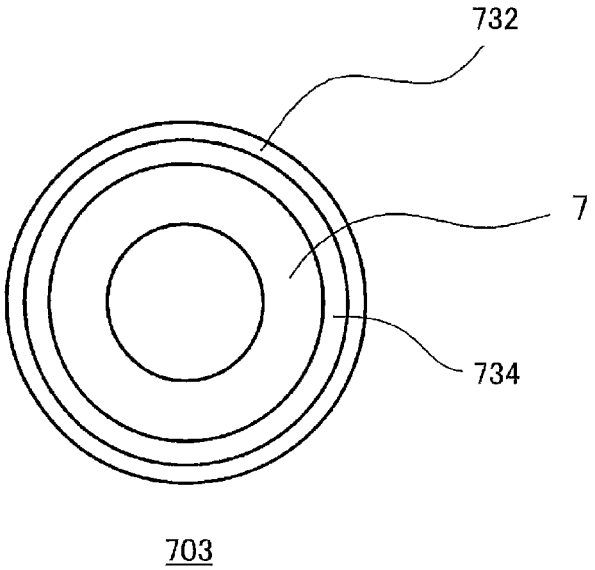
FIG. 12B is a rear side view of the cap of FIG. 12A.

FIGS. 12A and 12B show a cap 703 according to a seventh embodiment. The cap 703 has a flange portion 731, instead of the flange portion 8 of the cap 3 of the first embodiment. Configurations other than the flange portion 731 of the cap 703 are the same as those of the first embodiment, and detailed descriptions thereof are thus omitted.

As illustrated in FIGS. 12A and 12B, the flange portion 731 of the cap 703 includes a second orthogonal surface 732 whose inner end portion is spaced apart from the outer peripheral surface of the main body portion 7 in the radial direction. More specifically, the flange portion 731 includes a sloped surface 734 and the second orthogonal surface 732. The sloped surface 734 extends radially diagonally outward toward the rear side from the outer peripheral surface of the main body portion 7. The sloped surface 734 has an outer periphery from which the orthogonal surface 732 extends in the radial direction (in a direction orthogonal to the outer peripheral surface of the main body portion 7). In other words, the orthogonal surface 732 extends in the radial direction, but is not connected to the outer peripheral surface of the main body portion 7.

With this structure, at the time of fitting of the cap 703 to the casing 2, the flange portion 731 of the cap 703 can be deformed radially inward more reliably when passing the projection portions 14 in the front-rear direction, compared to the first embodiment.

In other words, a direction in which the flange portion 731 is deformed at the time of attaching the cap 703 to the casing 2 can be restricted. That is, the flange portion 731 is adapted to reliably deform in the radial direction.

While the invention has been described in detail with reference to the embodiments thereof, it would be apparent to those skilled in the art that various changes and modifications may be made therein without departing from the spirit of the invention.

What is claimed is:

1. A developer container comprising:

a casing having a filling port for filling developer therethrough, the filling port being defined by a cylindrical through-hole having an inner peripheral surface, and a protruding portion protruding radially inward from the inner peripheral surface; and a cap configured to be attached to the casing in a first direction for covering the filling port, the cap comprising:

a main body portion in a tubular shape having an outer peripheral surface; and a flange portion protruding radially outward from the outer peripheral surface in annular fashion, the flange portion being positioned downstream of the main body portion in the first direction and configured to be in contact with the inner peripheral surface, and the protruding portion being positioned upstream of the flange portion in the first direction upon attachment of the cap to the casing, wherein the flange portion has a downstream end portion formed with a sloped surface that slopes radially inward toward downstream in the first direction toward the outer peripheral surface of the main body portion, wherein the cylindrical through-hole has a downstream end portion, and wherein the casing further includes a contacting portion provided at the downstream end portion, the sloped surface of the flange portion being abuttable on the contacting portion upon attachment of the cap to the casing.

2. The developer container according to claim 1, wherein:

the protruding portion has a downstream end portion formed with a first orthogonal surface extending orthogonally to the first direction; and the flange portion has an upstream end portion formed with a second orthogonal surface extending orthogonally to the first direction, the second orthogonal surface opposing the first orthogonal surface in the first direction upon attachment of the cap to the casing.

3. The developer container according to claim 2, wherein the second orthogonal surface is spaced away from the outer peripheral surface of the main body portion.

4. The developer container according to claim 1, wherein the protruding portion has an upstream end portion formed with a slope that slopes radially inward toward downstream in the first direction.

5. The developer container according to claim 1, wherein the protruding portion comprises a plurality of protrusions.

6. The developer container according to claim 5, wherein the inner peripheral surface of the cylindrical through-hole defines a circumferential direction; and wherein the plurality of protrusions is aligned with each other in the circumferential direction.

7. The developer container according to claim 6, wherein the plurality of protrusions is also aligned with each other in the first direction.

8. The developer container according to claim 1, wherein the inner peripheral surface of the cylindrical through-hole defines a circumferential direction; and wherein the protruding portion is in a form of an annular protrusion extending in the circumferential direction over an entire circumference of the through-hole.

9. The developer container according to claim 1, wherein the cylindrical through-hole has an upstream open end in the first direction, and wherein the casing has a surrounding area surrounding the upstream open end; and wherein the main body portion has an upstream end face in the first direction substantially flush with the surrounding area in the first direction when the cap is attached to the casing.

10. The developer container according to claim 1, wherein the cylindrical through-hole has an upstream open end in the first direction, and wherein the casing has a surrounding area surrounding the upstream open end; and wherein the main body portion has an upstream end face positioned downstream of the surrounding area in the first direction when the cap is attached to the casing.

11. The developer container according to claim 1, further comprising a covering member configured to cover the cap when the cap is attached to the casing.

12. The developer container according to claim 1, further comprising a deformable member disposed downstream of the cap in the first direction when the cap is attached to the casing, the deformable member configured to contact the inner peripheral surface of the cylindrical through-hole.

13. The developer container according to claim 1, wherein the casing is formed with an opening for taking out the cap.

* * * * *